United States Patent [19]

Anahara et al.

[11] Patent Number: 4,480,435

[45] Date of Patent: Nov. 6, 1984

[54] FALSE-TWIST NOZZLE

[75] Inventors: Meiji Anahara, Kariya; Yoshihisa Suzuki, Chiryu; Shigeru Takasu, Kariya; Hiroshi Omori, Aichi, all of Japan

[73] Assignee: Kabushiki Kaisha Toyoda Jidoshokki Seisakusho, Kariya, Japan

[21] Appl. No.: 452,723

[22] Filed: Dec. 23, 1982

[30] Foreign Application Priority Data

Dec. 25, 1981 [JP] Japan ..... 56-209050

[51] Int. Cl.[3] ..... D02G 1/16; D01H 1/12

[52] U.S. Cl. ..... 57/333; 57/350

[58] Field of Search ..... 57/333, 350, 908

[56] References Cited

U.S. PATENT DOCUMENTS

| | | | |
|---|---|---|---|
| 3,910,021 | 10/1975 | Van Patten | 57/333 X |
| 4,141,121 | 2/1979 | Trifunovic | 57/333 X |
| 4,145,869 | 3/1979 | Duncan et al. | 57/350 X |
| 4,242,859 | 1/1981 | Lundgen | 57/333 X |

FOREIGN PATENT DOCUMENTS

| | | | |
|---|---|---|---|
| 63439 | 5/1977 | Japan | 57/333 |

*Primary Examiner*—Donald Watkins

*Attorney, Agent, or Firm*—Brooks, Haidt, Haffner & Delahunty

[57] ABSTRACT

A false-twist nozzle with an improved structure is provided herein. The false-twist nozzle according to the invention comprises a housing having a large-diameter yarn passage portion and an insert member having a small-diameter yarn passage portion and a fluid conduit hole. When the insert member is within the housing, a complete yarn passage hole is formed through the nozzle. Because the insert member is separable from the housing, drilling of the very small diameter fluid conduit hole can be made easily and accurately prior to insertion within the housing. Furthermore, the fluid conduit opening is disposed both annularly and angularly in the downstream direction with respect to the yarn passage hole, thereby increasing the twisting action induced by the flow of jetted fluid while preventing damage to the yarn.

12 Claims, 8 Drawing Figures

PRIOR ART

FALSE-TWIST NOZZLE

BACKGROUND OF THE INVENTION

The present invention relates to a false-twist nozzle; or more specifically, it relates to an improved structure of a false-twist nozzle which is applicable as a spinner for producing a so-called fasciated yarn by fluid jet process.

In spinning of such a fasciated yarn, fibers of sliver or roving are drafted by any suitable drafting mechanism and then transferred by fiber supply rollers, such as front rollers in the drafting mechanism, into a false-twist nozzle, where the fibers thus drafted are placed under the influence of aspirating and rotating actions imparted by a flow of jetted fluid whereby they are twisted and then untwisted, while being advanced continuously, to form a spun yarn by binding non-twisted core fibers with the ends of peripheral fibers.

For successful spinning of a yarn in such a process, it is essential for the above-said false-twister to have functions of drawing in and rotating, therefore twisting, the fibers of sliver properly by means of a flow of jetted fluid. To permit accomplishment of such functions, it is required that the false-twist nozzle should have its fluid conduit, through which fluid medium is jetted into a yarn passage in the nozzle, formed therein extending and opened into the yarn passage in an acute angle with respect to the longitudinal central axis thereof and eccentrically or in an offset relation to that central axis so as to impart effective aspirating and twisting actions on the fibers of yarn.

However, because the diameter of such fluid conduit falls usually within the range of less than 1 mm and it must be formed by drilling from the exterior of the nozzle body toward the yarn passage due to its inherent construction, it has been extremely difficult to drill such a small diameter with a desirable degree of accuracy. The difficulty lies in that a drill bit to be used for making a small diameter is very liable to be bent or even broken during drilling operation and that such a drill, if not bent or broken, tends to be deflected or to make a spin-out at its tip end easily in drilling, thus inviting poor accuracy in positioning of opened outlet of the fluid conduit, with a result that fiber twisting action of the false-twist nozzle will be degraded by inaccurate tangential relation of the fluid conduit to the yarn passage. In addition, the blind drilling of the fluid conduit hole being formed by drilling makes it practically impossible to check its opened outlet for being positioned properly, and an error in the outlet position, if any, cannot be remedied. Furthermore, since drilling must be performed from the exterior of the false-twist nozzle body toward the yarn passage formed therein, it is inevitable that the innermost end edge portion of the conduit hole drilled tangentiably to and in communication with the yarn passage will be formed with a harmful burr which may cause damages to the yarn moving past the passage. To make matters worse, it is very difficult to thoroughly deburr the conduit hole because the yarn passage is formed with a relatively small diameter and also the outlet of the drilled fluid conduit hole is positioned deep within the yarn passage. Presence of burr thus formed at the fluid conduit outlet in the yarn passage may seriously affect the twisting effect of the false-twist nozzle because smooth flow of jetted fluid is obstructed by such burr.

SUMMARY OF THE INVENTION

The object of the present invention is to remove above-mentioned drawbacks of prior false-twist nozzles by providing a false-twist nozzle of an improved configuration according to which drilling of the fluid conduit hole from its inner outlet side under a visible condition is made possible, thereby preventing improper opening of the fluid conduit into the yarn passage and formation of harmful burr exposed to the yarn passage.

The above and other objects, features and advantages of the present invention will become more apparent to those skilled in the art from the following detailed description of preferred embodyment of the invention, taken in conjunction with the accompanying drawings, wherein:

DETAILED DESCRIPTION OF PREFERRED EMBODIMENT

Figure 1:
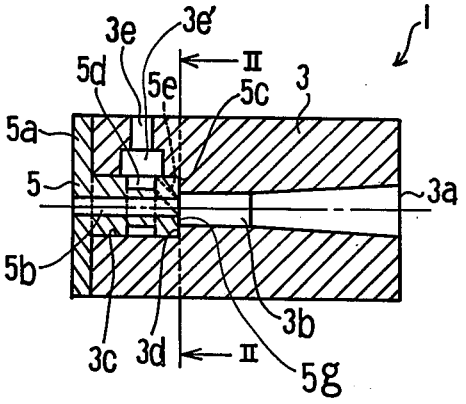
FIG. 1 is a side sectional view showing a preferred embodiment of the false-twist nozzle constructed according to the present invention.
Figure 2:
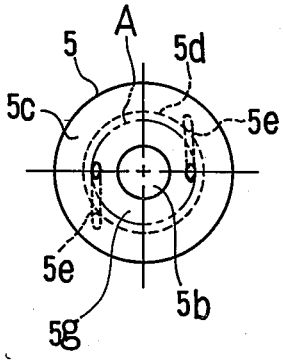
FIG. 2 is an enlarged sectional view of only the insert member in the nozzle, taken along as seen from the line II—II of FIG. 1.

Referring to FIGS. 1 and 2 which illustrate a preferred embodiment of the invention, the false-twist nozzle constructed according thereto and designated generally by a reference numeral 1 comprises a housing 3 and an insert member 5. In the housing 3 are formed a yarn discharging outlet **3*a* in a tapered cylindrical section narrowing in the upstream direction of the nozzle passage as viewed in FIG. 1, a large-diameter yarn passage hole 3*b* with a cylindrical section connected smoothly to the cylindrical taper of the yarn discharging outlet 3*a*, and an insert member receiving hole 3*c* having a diameter which is greater than that of the yarn passage hole 3*b*, all these holes 3*b*, 3*c* and the outlet 3*a* being formed in communication and in a coaxial relation to one another, thus providing a through hole or nozzle passage in the housing 3. Though the yarn discharging outlet 3*a*, yarn passage hole 3*b* and insert receiving hole 3*c* may be all formed by a squared section, respectively, if it is desired to do so, it is most desirable to provide these into a circular section by drilling for the sake of ease of machining. The yarn passage hole 3*b* and the insert receiving hole 3*c* are connected to each other at a stepped section therebetween, or at an end wall surface 3*d* formed on the inner end of the insert receving hole 3*c*, and the insert member 5** is inserted into its receiving hole 3c until its forward or downstream-facing end 5c abuts with the end wall surface 3d in a snug airtight fit. The cylidrical insert member 5 is provided with a flanged portion 5a at the left end thereof, as shown in FIG. 1, which may be used conveniently to hold the insert member 5 when fitting it into or removing it from the receving hole 3c, although the portion 5a may be dispensed with if it is not necessary. The insert member 5 is formed with a longitudinal through-hole or a small-diameter yarn passage hole 5b. Though this yarn passage hole 5b may be shaped in any section, a circular form would be most convenient in view of ease of machining. The yarn passage hole 5b in the insert member 5 has a diameter which is smaller than that of the yarn passage hole 3b formed in the housing 3, and the former is positioned in coaxial relation to the latter when the insert member 5 is fitted to place in its receiving hole 3c. The downstream facing end surface 5c of the insert member 5, or the end surface thereof adjacent the yarn passage hole 3b, is positioned normal to the common axis of the yarn passage holes 3b and 5b, and is engageable by contact with the end wall surface 3d in the housing.

The cylindrical insert member 5 has on its circumference an annularly recessed portion 5d, while the housing 3 has a fluid or air supply inlet 3e forward therein and connected to any suitable fluid or air source (not shown). This air supply inlet is provided in such a way that it is in communication with part of the abovesaid recessed portion 5d on the insert member 5 so that an air storage compartment is formed by and between the annularly recessed portion 5d and part of the inner wall surface of the insert receiving hole 3c.

A fluid or air conduit hole 5e extending between the annular recess 5d and the end surface 5c, within the forwardly exposed portion 5g, is formed in the insert member 5 at an acute angle with respect to the longitudinal axis of the yarn passage hole 3b, 5b as shown in FIG. 1. Therefore, the air conduit hole 5e is opened, at its upstream end, into the annular recess 5d and, at the downstream end, into the large-diameter yarn passage hole 3b in such a position that the opening of the air conduit hole 5e through the exposed portion 5g of the end wall 5c is substantially tangential to an imaginary circle "A" drawn, as indicated by a phantom line in FIG. 2, on the end surface 5c of the insert member 5 concentrically with the circular section of the yarn passage hole 5b. This imaginary circle "A" has a diameter which is substantially equal to or slightly smaller than that of the yarn passage hole 3b formed in the housing 3.

Figure 4:
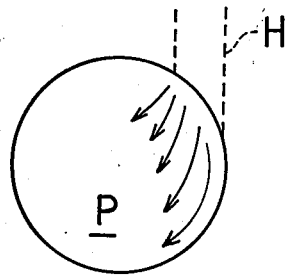
FIG. 4 is an enlarged schematic diagram illustrating the action of jetted fluid according to prior false-twist nozzles.
Figure 5:
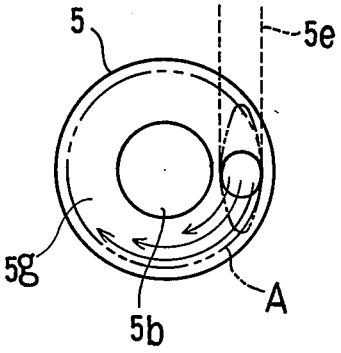
FIG. 5 is an enlarged schematic diagram similar to FIG. 4, but showing the fluid action obtainable from the false-twist nozzle according to the present invention.

Because the insert member 5 is thus seperable from the housing 3 and therefore it can be machined independently thereof according to the above-illustrated embodiment of the invention, the air conduit hole 5e in the insert member 5 may be formed for example by drilling from the end surface 5c toward the annular recess 5d of the insert member 5 under an easily visible condition. Accordingly, not only the positional accuracy can be achieved in drilling a hole as the air conduit in a false-twist nozzle which calls for a very high standard of machining accuracy, but also little burr is produced, or removed easily if any, on the outlet edge of the air conduit hole 5e or on the side past which a yarn is moved. Therefore, the fear of damaging the yarn by such burr may be eliminated. Furthermore, because the air conduit hole 5e is opened on its outlet side in an oval shape, as shown in FIG. 5, which is positioned substantially tangential to the imaginary circle "A" as defined previously, diffusion of the air jetted from the air conduit 5e can be much reduced thereby to increase the efficiency in twisting. Referring to the same FIG. 5, if the air conduit hole 5e is formed with a relatively greater acute angle with respect to the axis of the yarn passage holes 3b, 5b, it will result in an opening with a longer oval shape as drawn by a phantom line with part of the opening or the air outlet being traversed by the imaginary circle "A" as shown in FIG. 5, but the effect obtainable from such an opening is substantially equivalent to that from the other opening drawn by a solid line in FIG. 5. By comparison in prior false-twist nozzles in which the air conduit hole H is opened into the yarn passage P in direct tangential relation thereto, the flow of jetted air tends to be diffused easily as illustrated in FIG. 4, so that formation of A vortex of air flow within the yarn passage tends to be disturbed with the result that the desired twisting action of jetted air is adversely affected.

It is preferred that the large-diameter yarn passage hole 3b should be provided in a cylindrical form with a diameter ranging from 2 to 5 mm to allow a strand of yarn to be placed in contact with the vortex of jetted air from the air conduit hole 5e for a proper length of time and that the yarn discharging outlet 3a be formed in a tapered section widening outwardly to permit smooth discharging of a spun yarn as well as the air, although both of the yarn passage hole 3b and the yarn discharging outlet 3a may be shaped either into a cylindrical or tapered section as required.

Though provision of a single air conduit hole 5e may serve the purpose of false twisting, it is preferable that a plurality of such air conduit holes 5e, 5e' (FIG. 2) should be provided so as to create vortex of jetted air with the least irregularity, and the number of such air conduit holes 5e may be determined according to the condition under which spinning is to be carried out.

In the embodiment so far described, the large-diameter yarn passage hole 3b and the yarn discharging outlet 3a are formed directly in the housing 3, but these may be formed in a second insert member separable from the housing 3 so as to facilitate machining thereof and such second insert member may be made of any suitable wear-resistant material. Furthermore, it may be so arranged that the second insert member is interchangeable with another member having different configuration so as to meet varying spinning conditions.

Figure 3:
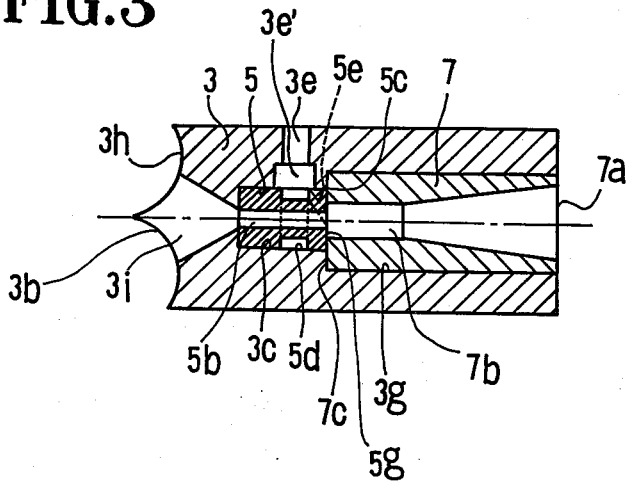
FIG. 3 is a side sectional view showing a modified embodiment of the false-twist nozzle of the invention.

Referring now to FIG. 3 which illustrates a modified embodiment of the invention, the housing 3 is provided therein with two coaxial holes 3c and 3g for receiving a first insert member 5 and a second insert member 7, respectively. The first insert member 5 is substantially equivalent in construction and function to the counterpart in the previous preferred embodiment in that both insert member 5 have a small-diameter yarn passage hole 5b, one or more air conduit holes 5e, 5e' and an annularly recessed portion 5d in similar forms and positions.

In the second insert member 7 are drilled a large-diameter yarn passage hole 7b and a yarn discharging outlet 7a. These are basically of the same configuration as the counterparts 3b and 3a in the previous preferred embodiment. The first insert member 5 should preferably have a diameter which is substantially equal to or smaller than that of the second insert member 7. Positioning of the first insert member 5 in radial direction is secured by fitting contact between the peripheral surface thereof and the inner surface of the first insert receiving hole 3c formed in the housing 3; while positioning thereof in axial direction is accomplished by engagement between the left end surface of the first insert member 5 and the mating left end surface of the insert receiving hole 3c. On the other hand, the second insert member 7 is radially positioned by fitting contact between the peripheral surface thereof and the inner surface of the second insert receiving hole 3g formed in the housing 3; while it is axially positioned by engagement between the left end surface 7c thereof and the right end surface of the insert member 5.

As shown in FIG. 3, the left end of the housing 3 comprises two surfaces 3h curved in accordance with front rollers (not shown), and is provided with a fiber introducing inlet 3i having a conical shape with progressively reducing section or any similar shape so that fibers of sliver being fed in a bundle form may be collected together and then introduced smoothly into the small-diameter yarn passage hole 5b.

Figure 6:
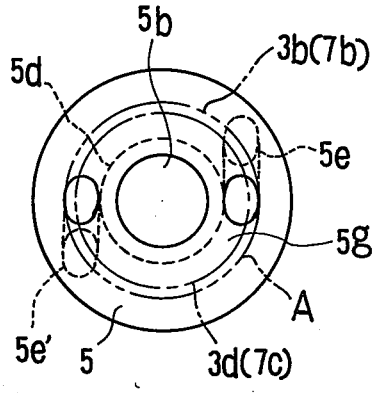
FIG. 6 is an enlarged sectional view similar to FIG. 2, but showing only the insert member of the modified embodiment of the invention illustrated in FIG. 3.

In either the FIG. 1 or the FIG. 3 embodiment, the imaginary circle "A" to which the air conduit hole 5e is to be opened tangentially (see FIG. 2) may have a diameter greater than that of the large-diameter yarn passage hole 3b or 7b, as shown in FIG. 6. In this case, part of the opening of the air conduit hole 5e is blocked by the end surface 3d in the housing 3 in which the yarn passage hole 3b is drilled (FIG. 1) or by the end surface 7c of the insert member 7 in which the yarn passage hole 7b is formed (FIG. 3). Accordingly, the air conduit hole 5e to be thus formed must be designed carefully with part of the air outlet to be blocked taken into previous consideration. In such an arrangement of the air conduit hole 5e, the area of its opening adjacent the inner wall surface of the yarn passage hole 3b or 7b may be enlarged with the result of increasing fiber twisting action by jetted air.

Figure 7:
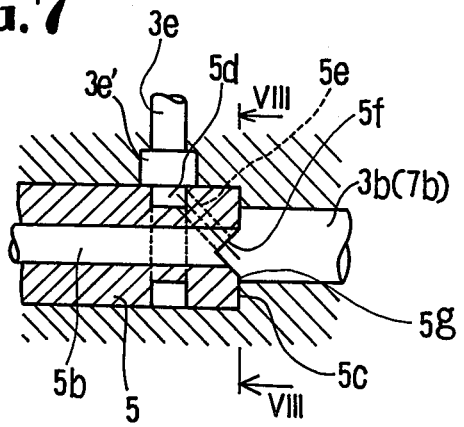
FIG. 7 is an enlarged fragmentary side sectional view providing still another embodiment of the invention.
Figure 8:
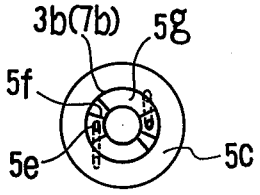
FIG. 8 is an end view of only the insert member as seen from the line VIII—VIII of FIG. 7.

A further modification according to the invention is shown in FIGS. 7 and 8, in which a cut face 5f is provided on the end surface 5c of the insert member 5 in such a way that the cut face 5f may be positioned substantially normal to the axis of the air conduit hole 5e, whereby drilling of the air conduit hole 5e can be further facilitated because the drilling may be initiated in a normal relation to a flat face or to the cut face 5f.

Thus, according to the present invention in which an insert member containing a fluid or air conduit hole is fitted in a housing of the false-twist nozzle, it is made practically possible to form the conduit hole, for example, by drilling from the air outlet side thereof under a visible condition so that a high standard of machining accuracy may be maintained and the conduit hole thus machined be checked easily for having an intended level of accuracy. Furthermore, according to the invention, the air conduit hole is opened not directly into the yarn passage hole where a yarn is passed through while in contact with the inner wall surface thereof, but into the passage hole via a plane which is substantially perpendicular to the axis of the passage hole. Therefore, yarn quality will not be affected by burr or the like formed at the outlet of the air conduit hole. Such defects if any at the outlet may be removed very easily as required because the air conduit hole is formed in an insert member separable from the housing. Since the air conduit hole is thus formed to a high level of accuracy and maintenance of such machining accuracy is easier as compared with the relevant prior art, quality variation of yarns produced from one spinning unit to another can be much reduced, thus permitting production of spun yarns with unifrom quality. As a further advantage of the false-twist nozzle constructed according to the invention, durability of the nozzle may be improved by using any suitable wear-resistant material for the insert member 5 containing therein the yarn passage hole 5b which is subjected to abrasion effect of the yarn passing therethrough. Even if the insert member is worn after a considerable period of use, only the insert member needs to be replaced with a new one without renewing the nozzle as a whole, thus the use of insert member offering an economical advantage, as well.

While the invention has been illustrated and described with reference to various specific embodiments thereof, it is to be understood by those skilled in the art that various changes in the details of construction or arrangement may be made without departing from the spirit and scope of the invention.

What is claimed is:

1. A false-twist nozzle for producing a spun yarn from yarn fibers, said nozzle having a body including an imaginary longitudinal central axis, an outer surface, an upstream end and a downstream end, and comprising means defining a yarn passage hole extending along said longitudinal axis between said ends for passage of said yarn fibers through said body, said yarn passage hole means comprising means defining a small hole portion thereof extending inwardly from said upstream end to an interior location within said body, a larger hole portion thereof conjoining with said small hole portion and extending from said interior location towards said downstream end, and a downstream-facing interior surface of said body substantially surrounding said small hole portion at said interior location; means defining a yarn-spinning fluid conduit of said body including a discharge end thereof at a location on said interior surface which is laterally spaced from said small hole portion and adjacent to the periphery of said larger hole portion, at least the length portion of said fluid conduit which is adjacent to its said discharge end being angularly disposed with respect to said longitudinal axis of said body for introducing yarn-spinning fluid into said larger hole portion in a direction which is both downstream and annular within said larger hole portion; and means defining a second yarn-spinning fluid conduit of said body including a discharge end thereof at a location on said interior surface which is laterally spaced from said small hole portion on the side thereof which is opposite to said location of the discharge end of the first said yarn-spinning fluid conduit, and adjacent to the periphery of said larger hole portion, at least the length portion of said second fluid conduit which is adjacent to its said discharge end being angularly disposed with respect to said longitudinal axis of said body for introducing additional yarn-spinning fluid into said larger hole portion in a direction which is downstream and annular within said larger hole portion to augment the flow of said yarn-spinning fluid introduced through the first said fluid conduit.

2. A false-twist nozzle for producing a spun yarn from yarn fibers, said nozzle having a body including an imaginary longitudinal central axis, an outer surface, an upstream end and a downstream end, and comprising a housing member and an insert member secured within said housing member substantially in alignment with said longitudinal axis of said body, and means defining a yarn passage hole extending along said longitudinal axis of said body between its said ends for passage of said yarn fibers through said body, said insert member having an outer surface, an outer end, and a downstream-facing inner end, said yarn passage hole means comprising means defining a small hole portion thereof extending through said insert member inwardly from said upstream end of said body to its said inner end, a large hole portion thereof conjoining with said small hole portion and extending within said housing member from said inner end of said insert member towards said downstream end of the body; and means defining a yarn-spinning fluid conduit extending through said insert member including a discharge end thereof located on said inner end of said insert member at a location thereon which is laterally spaced from said small hole portion and adjacent to the periphery of said larger hole portion, at least the length portion of said fluid conduit which is adjacent to its said discharge end being angularly disposed with respect to said longitudinal axis of said body for introducing yarn-spinning fluid into said larger hole portion in a direction which is both downstream and annular within said larger hole portion.

3. A false-twist nozzle according to claim 2, wherein said insert member has means defining an annularly extending recessed portion of its said outer surface at a location along its length between said outer and inner ends thereof, and said fluid conduit extends from an end thereof within said recessed portion to said inner end of said insert member.

4. A false-twist nozzle according to claim 3, wherein said insert member includes a flat surface portion substantially surrounding at least one end of said yarn-spinning fluid conduit and disposed substantially perpendicular to the direction of said fluid conduit.

5. A false-twist nozzle according to claim 4, wherein said inner end of said insert member has means defining a substantially V-shaped cut portion, said flat surface portion being formed by a surface of said V-shaped cut portion.

6. A false-twist nozzle according to claim 5, wherein said V-shaped cut portion extends across said insert member inner end to provide surface thereof on both sides of said small hole portion therein, said insert member having a second yarn-spinning fluid conduit extending therethrough and including a discharge end of said second fluid conduit located on a surface of said V-shaped cut portion located on that side of said small hole portion which is opposite from that of said V-shaped cut portion surface which forms said flat surface portion surrounding said end of the first said fluid conduit.

7. A false-twist nozzle according to claim 3, wherein said housing member defining an insert member receiving aperture therein, and means defining a yarn-spinning fluid supply inlet conduit extending through said housing member to said insert member receiving aperture at a location therein providing for fluid communication between said inlet conduit and said annular recessed portion of said insert member.

8. A false-twist nozzle according to claim 7, wherein said yarn-spinning fluid supply inlet conduit includes a widened fluid storage portion thereof adjacent to said insert member receiving aperture, the width of said widened fluid storage portion being larger than the width of said annular recessed portion of said insert member whereby said annular recessed portion provides a portion of said yarn-spinning fluid conduit which is narrower than said fluid strage portion thereof.

9. A false-twist nozzle according to claim 2, wherein said housing member has an upstream end, and means defining an insert member receiving aperture extending into said housing member for receiving said insert member from said upstream end.

10. A false-twist nozzle according to claim 9, wherein said insert member has a peripherally extending flange portion defining an upstream end thereof, said flange portion being in abutment with said upstream end of said housing member.

11. A false-twist nozzle according to claim 2, wherein said housing member has a downstream end, and means defining an insert member receiving aperture extending into said housing member for receiving said insert member from said downstream end.

12. A false-twist nozzle according to claim 11 which further comprises a second insert member received in said insert member receiving aperture from said downstream end of said housing member and secured therein between the first said insert member and said downstream end of said housing member, said larger hole portion of said yarn passage hole extending through said second insert member.

* * * * *